United States Patent [19]

Suwa

[11] Patent Number: 5,056,826

[45] Date of Patent: Oct. 15, 1991

[54] QUALITY INDICATOR FOR GEMSTONE

[75] Inventor: Yasukazu Suwa, Tokyo, Japan

[73] Assignee: Suwa Boeki Kabushiki Kaisha, Tokyo, Japan

[21] Appl. No.: 542,750

[22] Filed: Jun. 25, 1990

[30] Foreign Application Priority Data

Dec. 14, 1989 [JP] Japan ..... 1-144501

[51] Int. Cl.[5] ..... B42D 15/00

[52] U.S. Cl. ..... 283/67; 283/115; 283/117

[58] Field of Search ..... 283/70, 74, 115, 117, 283/67; 434/98, 99, 100, 377, 386

[56] References Cited

U.S. PATENT DOCUMENTS

| | | | |
|---|---|---|---|
| 935,474 | 9/1909 | Eckart | 434/98 |
| 2,636,286 | 4/1953 | Bowman | 434/98 |
| 2,899,755 | 8/1959 | Terilli | 434/98 |
| 4,523,852 | 6/1985 | Bauer | 434/98 |
| 4,527,895 | 7/1985 | Rubin | 283/74 |

*Primary Examiner*—Frank T. Yost
*Assistant Examiner*—Hwei-Siu Payer
*Attorney, Agent, or Firm*—Laubscher, Presta & Laubscher

[57] ABSTRACT

The present invention relates to a quality indicator for a gemstone and more particularly to such a quality indicator for a gemstone composed of a chart with coloration in a plurality of colors and an indication of a grading scale in terms of the grades expressed in and with reference to the colors of the chart.

5 Claims, 2 Drawing Sheets

QUALITY INDICATOR FOR GEMSTONE

BACKGROUND OF THE INVENTION

The conventional written guarantee for gemstones merely bears a statement of the name of the gemstone, the number of carats, the country of origin, and so forth and a statement to the effect that the seller will take responsibility for the quality of the gemstone. The purchaser has consequently had no other way of having an understanding that the gemstone is such a gemstone as described on such a written guarantee and only to such an extent as stated thereon.

In general, written guarantees for gemstones are prepared with the name of the gemstone, its weight, its country of origin, and its quality being stated in the specified columns thereon.

SUMMARY OF THE INVENTION

The present invention relates to a quality indicator for a written guarantee for a gemstone, which indicates the quality of a gemstone in a manner easy for a layman to understand and also in such a manner as is useful for getting an understanding of the qualitative characteristics of a gemstone.

As a matter of practice, it is a difficult task to appraise the quality of gemstones.

It can be understood that the beauty of gemstones is formed by a mixture of the factors mentioned in the following:

- Natural characteristics of the rough stone (which is approximately equal to the degree of transparency),
- Saturation (which means whether the color of the gemstone is close to the pure color or varying amounts of gray or brown may be present),
- Pleochroism (only in the case of those minerals with two or more colors in a doubly refractive crystals),
- Cut (i.e., proportions, external and symmetrical shape, and depth),
- Finish,
- Window, uneven color distribution or the abundance of color,
- Presence or absence of inclusions (i.e., matters contained in the gemstone), and
- Defects in the crystal that affect the durability.

The key point is how these factors can be appraised with a measure of objective relevance. Up to the present time, the appraisals of these factors have been ambiguous and vague, and, in the absence of a system of appraisal based on these factors, the kind of written guarantees mentioned above have been prepared in practice.

The primary object of the present invention is to provide a quality indicator for gemstones which enables the issuer of guarantees for the quality of gemstones to enter such results of appraisal as can be explained in a clear and definite way and which also enables the receiver of such a guarantee easily to understand the positioning of the gemstone in quality, the said quality indicator being prepared on the basis of appraisal of the degree of color tone (hereinafter referred to as degree of tone) and degree of transparency (which is equivalent to what may be called "beauty grade"), to which the present inventor has paid attention.

Another object of the present invention is to provide a form of quality indicator for gemstones with a grading scale formed of an indication of grades with reference to the zones of several upper-ranking grades corresponding to the types of gemstones as stated on an array or table of colors, which is established by analyzing and classifying the degree of tone and the degree of transparency inherent in the gemstones and preparing the said array of colors by indicating the same hues or similar hues one by one in an orderly sequence, with a chart or matrix indicating the degree of tone or the degree of transparency on the vertical axis and indicating the other on the horizontal axis in a format corresponding to the grades in terms of the said degree of tone and the said degree of transparency as appraised of the particular gemstone. In accordance with the method of this invention, the said quality indicator with grading scale preferably is applied or secured onto a corner of the document bearing thereon a description of the merchandise name, the name of gemstone, and so forth, or a form corresponding to the grading scale mentioned above is printed directly on the document bearing a description of the merchandise name, the name of gemstone, and so forth.

By the expression, "analyzing and classifying the degree of tone and the degree of transparency inherent in the gemstones," is here meant, for example, a classification (for grading) in several stages with respect to the degree of tone and the degree of transparency as determined with reference to master stones.

By the expression, "the same hues or similar hues ... corresponding to the grades in terms of the said degree of tone and the said degree of transparency as appraised of the particular gemstone," is here meant to take as the basis red for ruby and green for emerald, for example, and to use such hues as are quite similar to the actual hues in correspondence to the particular grades of the gemstones. An array or table of colors is prepared by applying such hues of gemstones one by one in a proper sequence to the surface of the document delineated by the chart.

The position for the highest grade on the array of colors is different for different kinds of gemstones. Therefore, the grades are indicated for the positions in several upper-ranking grades by using such marks as "AAA", "AA", "A" in the proper places, and using the resulting form as a grading scale.

The form for a quality indicator for gemstones as proposed above in the present specification enables the seller to make a clear and definite description from the viewpoint as to what the beauty grade is and what the degree of tone is, and also makes it possible for the purchaser to get a sense of relief from apprehension, gaining an understanding about the positioning of the gemstone in its quality by ascertaining the quality of the gemstone as set forth on the quality indicator with reference to the scale of qualitative grades.

BRIEF DESCRIPTION OF THE DRAWINGS

The manner by which the above objects and advantages of the present invention are attained will be fully evident from the following detailed description when it is considered in light of the accompanying drawings, wherein.

DETAILED DESCRIPTION OF THE INVENTION

Now, the preferred embodiment of the present invention is described in detail with reference to the accompanying drawings.

Figure 1:
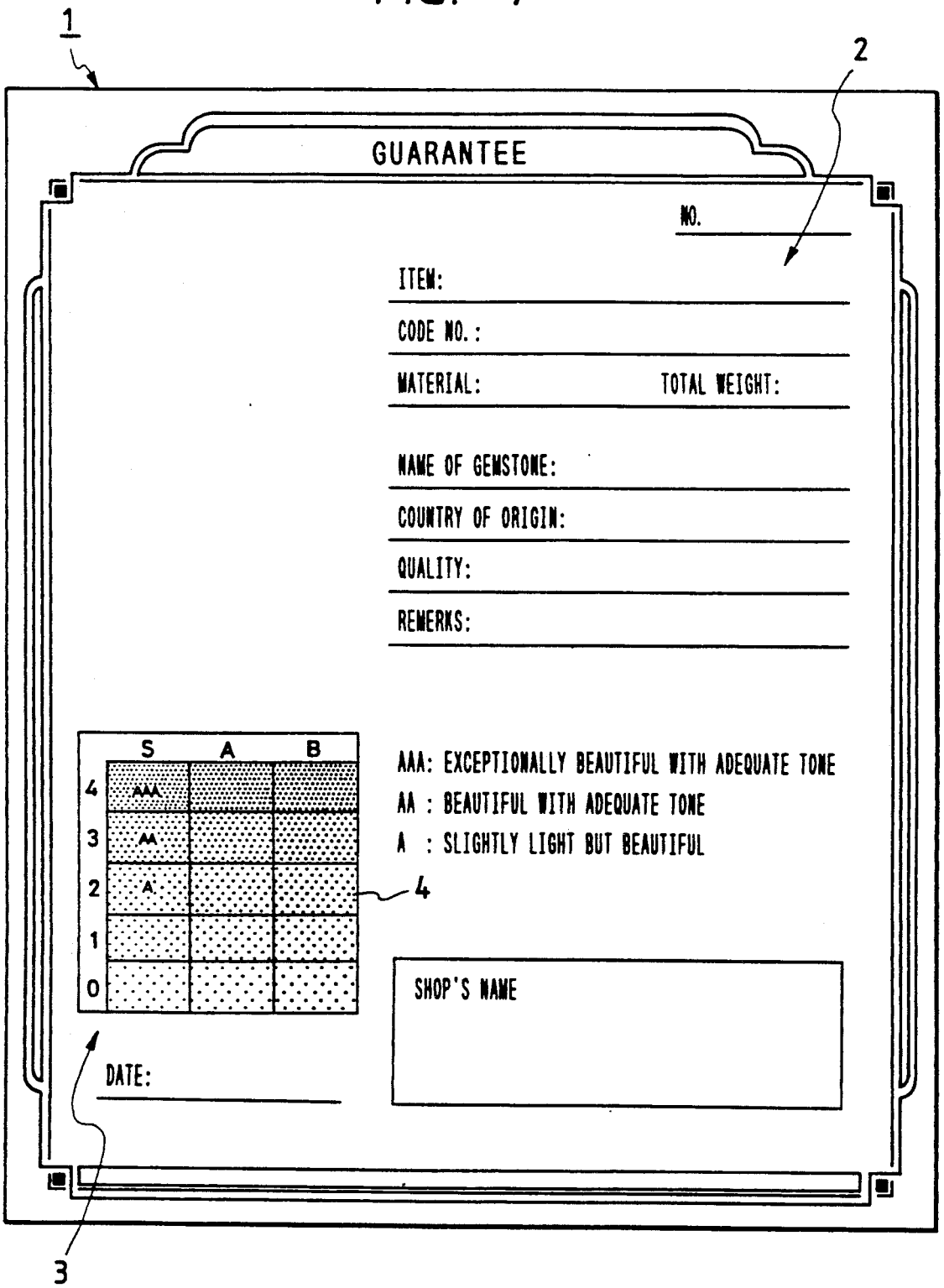
FIG. 1 is a front view of the quality indicator and guarantee document for a gemstone as prepared according to the present invention.
Figure 2:
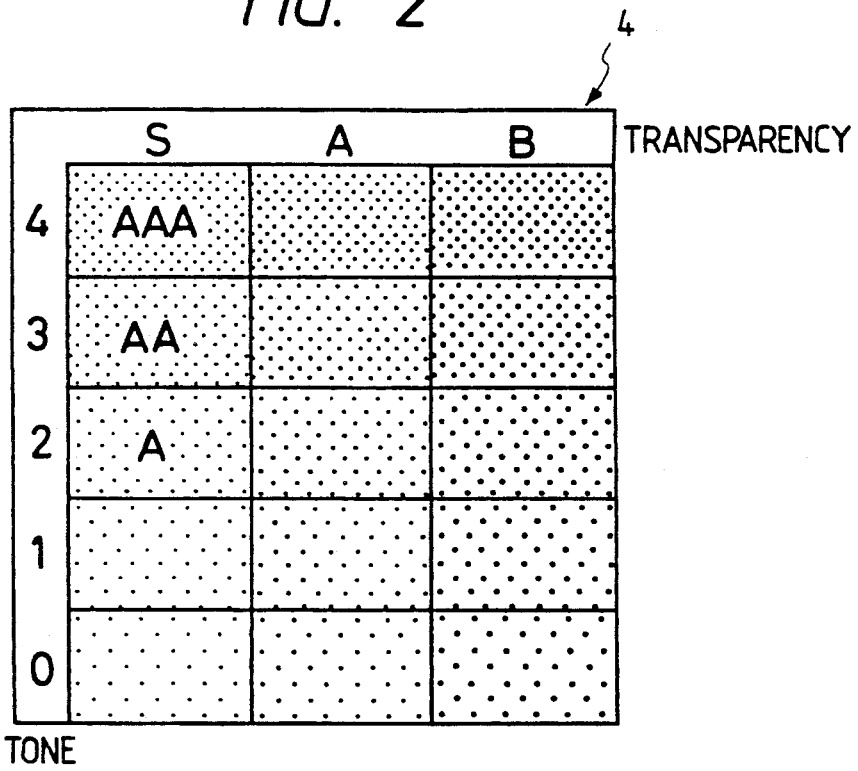
FIG. 2 is a front view of the scale of grades of the quality indicator prepared for the gemstone aquamarine, which is taken as an example here.

FIG. 1 is a front view of the quality indicator and guarantee document 1 for a gemstone prepared in accordance with one embodiment of the present invention. On the upper righthand corner 2 of the said guarantee are provided the columns for the entry of the merchandise item, the merchandise code number, the material, the total weight, the name of the gemstone, the country of origin, the quality, and so forth, and, in the lower left-hand corner 3 of the guarantee, the quality indicator 4 is positioned.

The quality indicator 4 includes a grading scale for aquamarine which, as taken here for an example, is in the form of a chart or matrix with the vertical scale divided into five sections and the horizontal scale divided into three sections, with the grades (S, A, and B) in expression of the degrees of transparency being indicated on the horizontal axis while the grades in terms of the degree of tone (4, 3, 2, 1, and 0) are indicated on the vertical axis, and the individual zones are colored on the basis of a master stone. For the highest grade of aquamarine of S4, the grade indication "AAA" is entered in this zone of S4, "AA" is entered in the zone for the second-ranking grade S3, and "A" is entered in the zone for the third-ranking grade S2.

Figure 3:
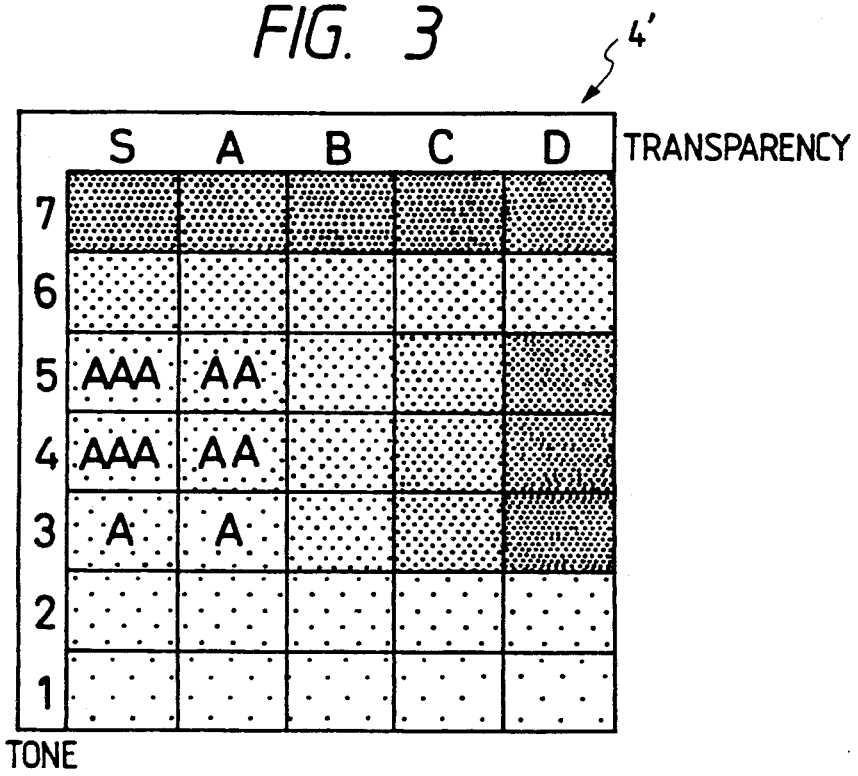
FIG. 3 is a front view of the scale of grades of the quality indicator prepared for the gemstone emerald, which is taken as another example here.

In FIG. 3 is shown a quality indicator 4' grading scale for emerald, and this grading scale is formed into a chart or matrix with its vertical scale divided into seven sections and with its horizontal scale divided into five sections, the grades (S, A, B, C, and D) of the degree of transparency being indicated on the horizontal axis and with the grades (7, 6, 5, 4, 3, 2, and 1) for the degree of tone being indicated on the vertical axis, and the individual zones in the chart are colored on the basis of the master stone. Since the highest grade for emerald is S4 and S5, the grade mark "AAA" is entered in these zones, the mark "AA" is entered in the zones A4 and A5 for the second-ranking grade, and the mark "A" is entered in the zones S3 and A3 for the third-ranking grade. The quality indicator with such a grading scale preferably is affixed on one corner of the guarantee document or the quality indicator is printed directly on the guarantee document.

Since the present invention provides the construction mentioned above for guarantees, the seller merely has to fill in the appraisal made of the gemstone in the guarantee with reference to the grading scale of the quality indicator and, as the grading scale preferably is provided on one corner of the guarantee, the seller can also explain the quality of the gemstone in a clear and specific manner, by referring the actual gemstone to the said grading scale, and the purchaser can make the transaction with a sense of relief from anxiety as it is possible to recognize the qualitative positioning of the gemstone on the basis of the same grading scale.

What is claimed is:

1. A quality indicator on a document for a gemstone, said quality indicator being provided with a grading scale, wherein said grading scale is characterized by being formed of:

(a) an array of colors prepared by analyzing the degree of color tone and the degree of transparency inherent in gemstones, the same or quite similar colors corresponding to the grades thereof being applied in an orderly sequence to the surface of the document in the form of a chart with one of the degree of color tone or the degree of transparency being indicated on a vertical axis of the chart and the other of these being indicated on a horizontal axis of the chart, and (b) an indication of grades expressed on said array of colors with respect to zones for several upper-ranking grades in corresponding to the type of a gemstone.

2. A quality indicator for a gemstone as claimed in claim 1, wherein the document is a guarantee document and the chart is affixed to one corner of the guarantee document for the gemstone.

3. A quality indicator for a gemstone as claimed in claim 1, wherein the document is a guarantee document and the chart is printed directly on one corner of the guarantee document for the gemstone.

4. A method for preparing a quality indicator for a gemstone, comprising the steps of:

(a) preparing a grading scale having an array of colors that are defined by analyzing the degree of color tone and the degree of transparency inherent in a gemstone and applying the same or quite similar colors corresponding to the grades thereof in an orderly sequence to a chart with one of the degree of color tone or the degree of transparency being indicated on a vertical axis of the chart and the other of these being indicated on a horizontal axis of the chart; and (b) providing indicia of grades expressed on said array of colors with respect to zones for several upper-ranking grades corresponding to the type of a gemstone.

5. The method of claim 4 further comprising the step of applying the chart to a guarantee document for the gemstone.

* * * * *